US005583521A

United States Patent [19]

Williams

[11] Patent Number: 5,583,521

[45] Date of Patent: Dec. 10, 1996

[54] COMPACT ANTENNA FOR PORTABLE MICROWAVE RADIO

[75] Inventor: Anthony D. Williams, Aptos, Calif.

[73] Assignee: GEC Plessey Semiconductors, Inc., Scotts Valley, Calif.

[21] Appl. No.: 514,392

[22] Filed: Aug. 11, 1995

[51] Int. Cl.[6] ..... H01Q 1/24

[52] U.S. Cl. ..... 343/702; 343/700 MS; 343/872

[58] Field of Search ..... 343/702, 700 MS, 343/846, 872; 340/825.34; H01Q 1/24

[56] References Cited

U.S. PATENT DOCUMENTS

| | | | |
|---|---|---|---|
| 4,571,595 | 2/1986 | Phillips et al. | 343/702 |
| 5,302,947 | 4/1994 | Fuller et al. | 340/825.34 |
| 5,343,319 | 8/1994 | Moore | 359/152 |
| 5,361,061 | 11/1994 | Mays et al. | 343/702 |
| 5,373,149 | 12/1994 | Rasmussen | 235/492 |
| 5,375,051 | 12/1994 | Decker et al. | 363/49 |
| 5,391,083 | 2/1995 | Roebuck et al. | 439/76 |
| 5,418,524 | 5/1995 | Fennell | 340/825.22 |

FOREIGN PATENT DOCUMENTS

| | | | |
|---|---|---|---|
| 24722 | 10/1994 | WIPO | H01Q 1/24 |

*Primary Examiner*—Hoanganh T. Le
*Attorney, Agent, or Firm*—Robert P. Sabath; Rajiv P. Patel

[57] ABSTRACT

A PCMCIA package with a shielded package for radio electronics is inserted into a selected PCMCIA slot with only one edge of the shielded package being immediately accessible. A microwave and radio frequency transparent containment is mounted at a selected edge of the shielded package. An antenna is mounted within the microwave and radio frequency transparent containment for electromagnetic communication through the microwave and radio frequency transparent containment.

11 Claims, 4 Drawing Sheets

COMPACT ANTENNA FOR PORTABLE MICROWAVE RADIO

FIELD OF INVENTION

This invention relates generally to microwave antennae, and more particularly to compact microwave antennae for portable microwave radio systems.

BACKGROUND OF THE INVENTION

Personal Computer Memory Card International Association (PCMCIA) cards are now ubiquitous devices used in many computer applications. U.S. Pat. No. 5,373,149 granted in 1994 to AT&T Bell Laboratories shows a PCMCIA wireless credit card modem fabricated using two credit card sized sections connected by a hinge. The first section contains modem circuitry, and the second section contains an antenna and radio circuitry.

A computer can act as the host for a PCMCIA card inserted into a receiving PCMCIA card.

It is desirable to develop a unitary, hingeless PCMCIA configuration which provides desirably compact antenna packaging without the antenna extending to an unnecessary amount out of the PCMCIA slot into which it has been inserted.

SUMMARY OF THE INVENTION

According to the present invention, a unitary PCMCIA package is developed which includes an antenna fabricated in one side thereof, for insertion into a PCMCIA slot with minimal protrusion of the antenna portion of the PCMCIA package from the PCMCIA slot.

According to one embodiment of the present invention, a PCMCIA package includes PCMCIA electronics in a shielded package. A microwave and radio frequency transparent containment is mounted on a selected edge of the shielded package for securing a paired L-shape antenna system having first and second L-shaped wires each having a long and a short leg and the long legs traversing complementary meandered zig-zag paths.

According to an embodiment of the present invention, the microwave and radio frequency containment includes first and second chambers defining internal surfaces securing respective ones of said first and second L-shaped wires within individual portions of the containment. The long legs of each of first and second L-shaped wires meander within a horizontal plane, ensuring radiation of electromagnetic energy within the plane of a computer acting as a host for a PCMCIA radio adapter, according to the present invention. According to one embodiment of the present invention, the meandering long legs of respective ones of said first and second L-shaped wired arc secured by the inner surfaces of said first and second chambers.

DESCRIPTION OF THE PREFERRED EMBODIMENT

Figure 1:
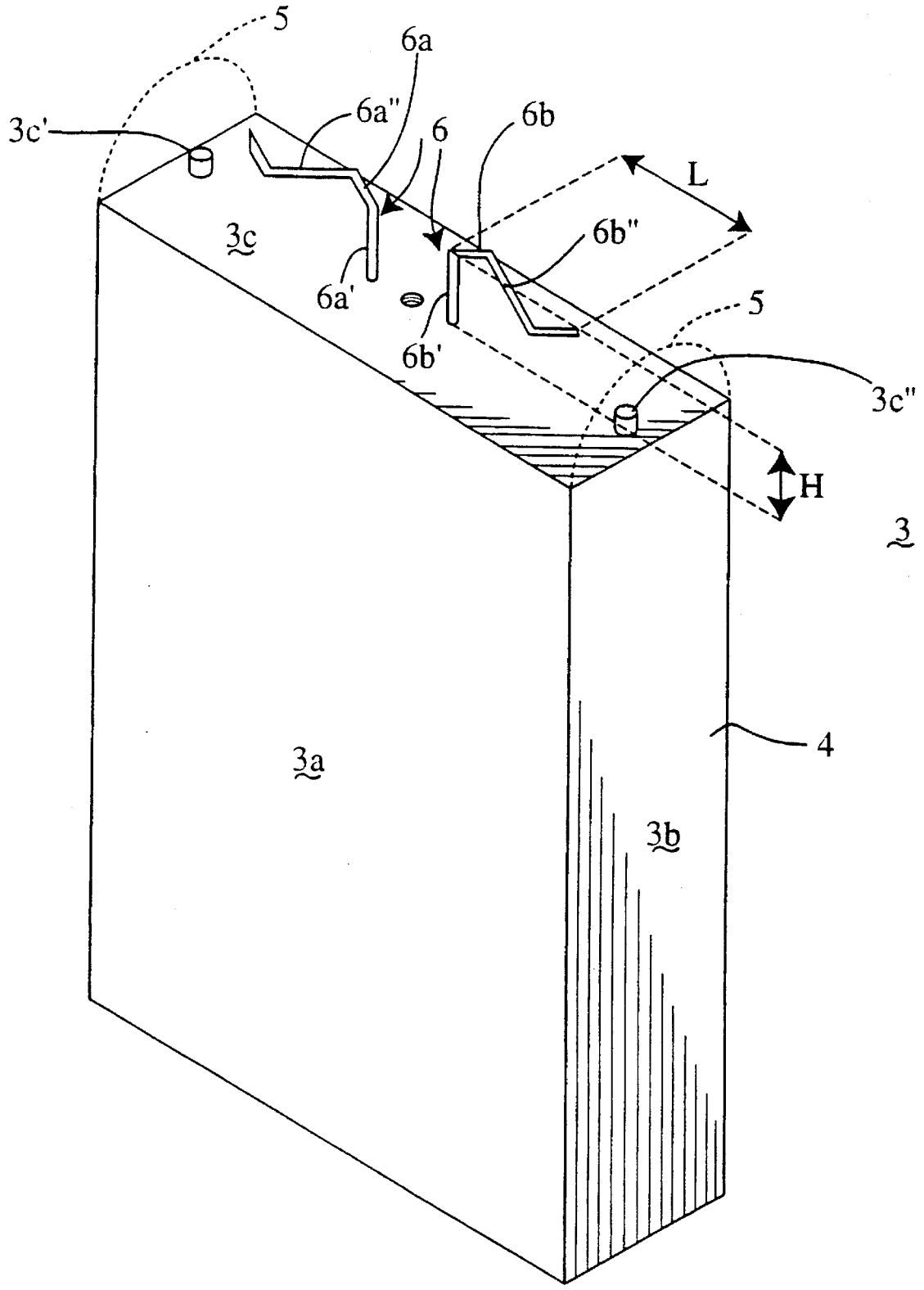
FIG. 1 is a diagram of a PCMCIA package according to the present invention, including a shielded package for radio electronics and a microwave and radio frequency transparent containment for a paired L-shape antenna system according to one embodiment thereof.

FIG. 1 is a diagram of a PCMCIA package 3 according to the present invention, including a shielded package 4 for radio electronics, and an electromagnetic radiation transparent containment 5 (suggested in phantom) which transmits, according to one embodiment of the present invention, either microwave and radio frequency, or both. Containment 5 contains a low profile, paired L-shape antenna system 6 including first and second legs respectively 6*a* and 6*b*, which are made according to one embodiment of 0.040" diameter, self-supporting cooper wire. First and second legs 6*a* and 6*b* are separated in a diversity pattern.

By employing first and second legs 6*a* and 6*b* of an antenna system according to the present invention, the use of a conventional Quarter Wave Monopole "Whip" Antenna is avoided. Such a whip antenna is physically large, and its vertical configuration makes it impossible to fit the antenna into a low profile enclosure. Shielded package 4 acts as a ground plane for antenna system 6. According to one embodiment of the present invention, the radio electronics within shielded package 4 is DE 6003 Radio Transceiver.

According to one embodiment of the present invention, shielded package 4 fits into a Type I PCMCIA slot and has dimensions of approximately 114 mm, 54.0 mm, and 3.3 mm. According to one embodiment of the present invention, shielded package 4 fits into a Type IV PCMCIA slot and has dimensions of approximately 114 mm by 57 mm, by 17 mm.

Shown in FIG. 1 are three sides of PCMCIA package 3, the front side 3*a*, the right side 3*b*, and the top side 3*c* which is the top edge of PCMCIA package 3 which is directly accessible to the user after PCMCIA package is substantially completely inserted into a receiving slot.

For securing containment 5 on top side 3*c* of PCMCIA package 3, top side 3*c* includes first and second dowel pins 3*c*' and 3*c*" fabricated according to one embodiment along a central axis of top side 3*c* near opposite ends of top side 3*c*. Dowel pins 3*c*' and 3*c*" extend vertically from the horizontal surface of top side 3*c*. At the center of top side 3*c* is defined therein a fixing hole 7 through which a screw (not shown) can be inserted to securing shielded package 4 and containment 5. Dowel pins 3*c*' and 3*c*" permit alignment of shielded package 4 and containment 5 during securing operation. Thus, according to one embodiment of the present invention, containment 5 extends in length to cover an entire narrow edge of shielded package 4, securing antenna system 6 and containment 5 robustly and firmly in place, eliminating significant leverage and attendant possible breakage of antenna system 6 and containment 5 from shielded package 4.

According to one embodiment of the present invention, legs 6*a* and 6*b* of antenna system 6 traverse complementary paths which meander in a horizontal plane within containment 5. Legs 6*a* and 6*b* include respective vertical bases 6*a*' and 6*b*', and corresponding horizontal portions 6*a*" and 6*b*". Each of vertical bases 6*a*' and 6*b*' has a height of "H". Respective bases 6*a*' and 6*b*' extend into shielded package 4 for support and suitable connection to receiver and transmitter circuitry of a DE 6003 Radio Transceiver circuit board.

Each of horizontal portions 6a" and 6b" has a projected length of "L" along a selected axis in the horizontal plane in which or about which the horizontal portions 6a" and 6b" meander. According to the diversity configuration of antenna system 6 of the present invention, horizontal portions 6a" and 6b" meander in opposite directions along a common axis. According to one embodiment of the present invention, length "L" is tuned to a selected frequency of operation, for example 2.45 Gigahertz. According to one embodiment of the present invention, H=5 mm, and L=20 min. The total wire length according to this embodiment is 31.2 mm, which corresponds approximately to a one-quarterwave-length at an operating frequency of 2.45 Gigahertz. Antenna system 6 is sufficiently efficient to permit a useful operational range.

According to one embodiment of the present invention, the path of meandering of respective portions 6a" and 6b" follows a zig-zag path which can be contained in a substantially horizontal plane.

Figure 2:
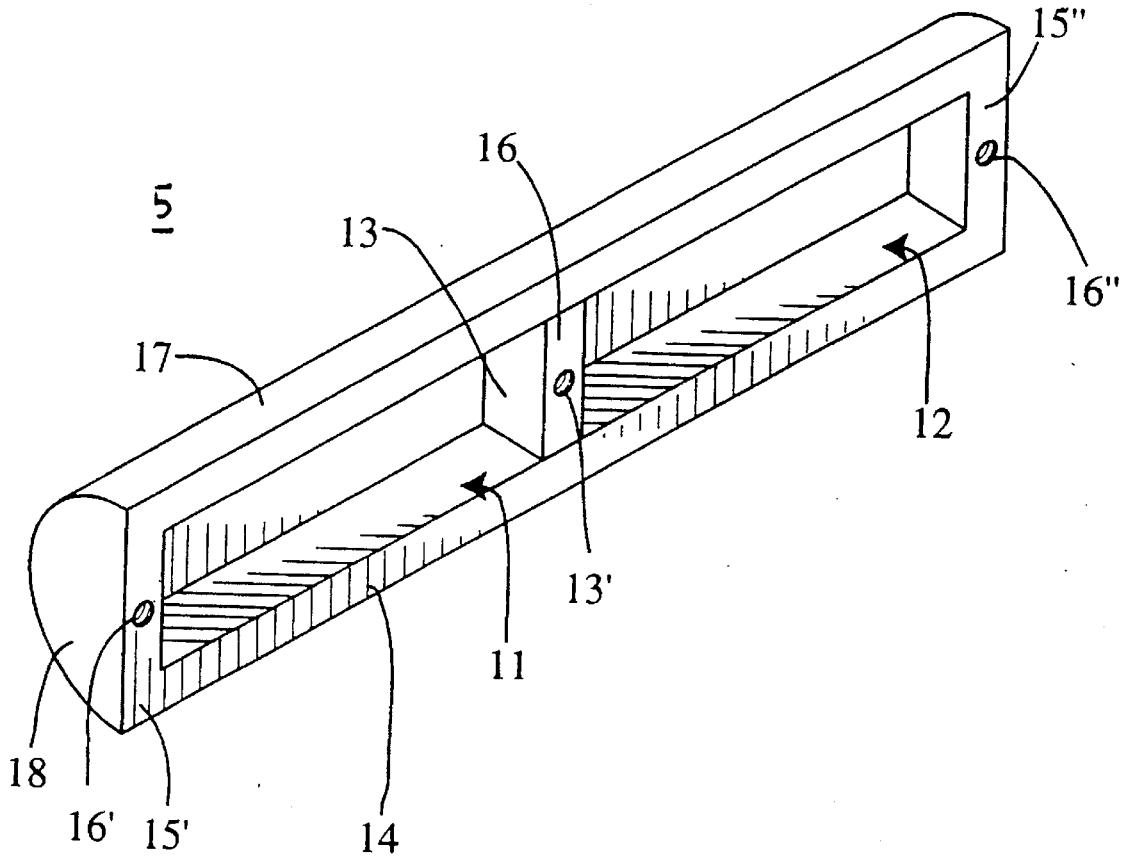
FIG. 2 is a diagram of the microwave and radio frequency transparent containment according to one embodiment, for containing the L-shape antenna system of the invention.

FIG. 2 is a diagram of the microwave and radio frequency transparent containment 5 according to one embodiment, for containing the L-shape antenna system 6 of the invention. Containment 5 includes first and second chambers 11 and 12 and a partition 13 separating chambers 11 and 12.

Chamber containment 5 defines an engagement surface 14 including a perimeter 15 and a central ridge portion 16 which is a surface of partition 13. Containment 5 includes an arched external surface 17 and first and second flat side surfaces 18, according to one embodiment of the present invention. Perimeter 15 of engagement surface 14 includes first and second ends 15' and 15" respectively defining holes 16' and 16" near the center of each end 15' and 15" for receiving respective dowel pins 3c' and 3c" for alignment. Central portion 16 defines tapped hole 17 for a screw (not shown) from the cavity of shielded package 4. Accordingly, a single screw extending top surface 3c of shielded package 4 can mount containment 5 in proper alignment onto a selected edge of PCMCIA package 3, holding containment and shielded package 4 robustly together without significant risk of antenna system 6 becoming damaged at its exposed location at the edge of PCMCIA package 3.

According to an embodiment of the present invention, first and second chambers 11 and 12 of microwave and radio frequency containment 5 define internal surfaces which secure respective ones of said first and second L-shaped wires 6a and 6b within individual portions of containment 5. The long legs 6a" and 6b" of each of first and second L-shaped wires 6a and 6b meander within a horizontal plane, ensuring radiation of electromagnetic energy within the plane of a computer acting as a host for a PCMCIA radio adapter, according to the present invention. According to one embodiment of the present invention, the meandering long legs 6a" and 6b" of respective ones of said first and second L-shaped wires 6a and 6b are secured by respective ones of said inner surfaces of said first and second chambers 11 and 12.

Figure 3:
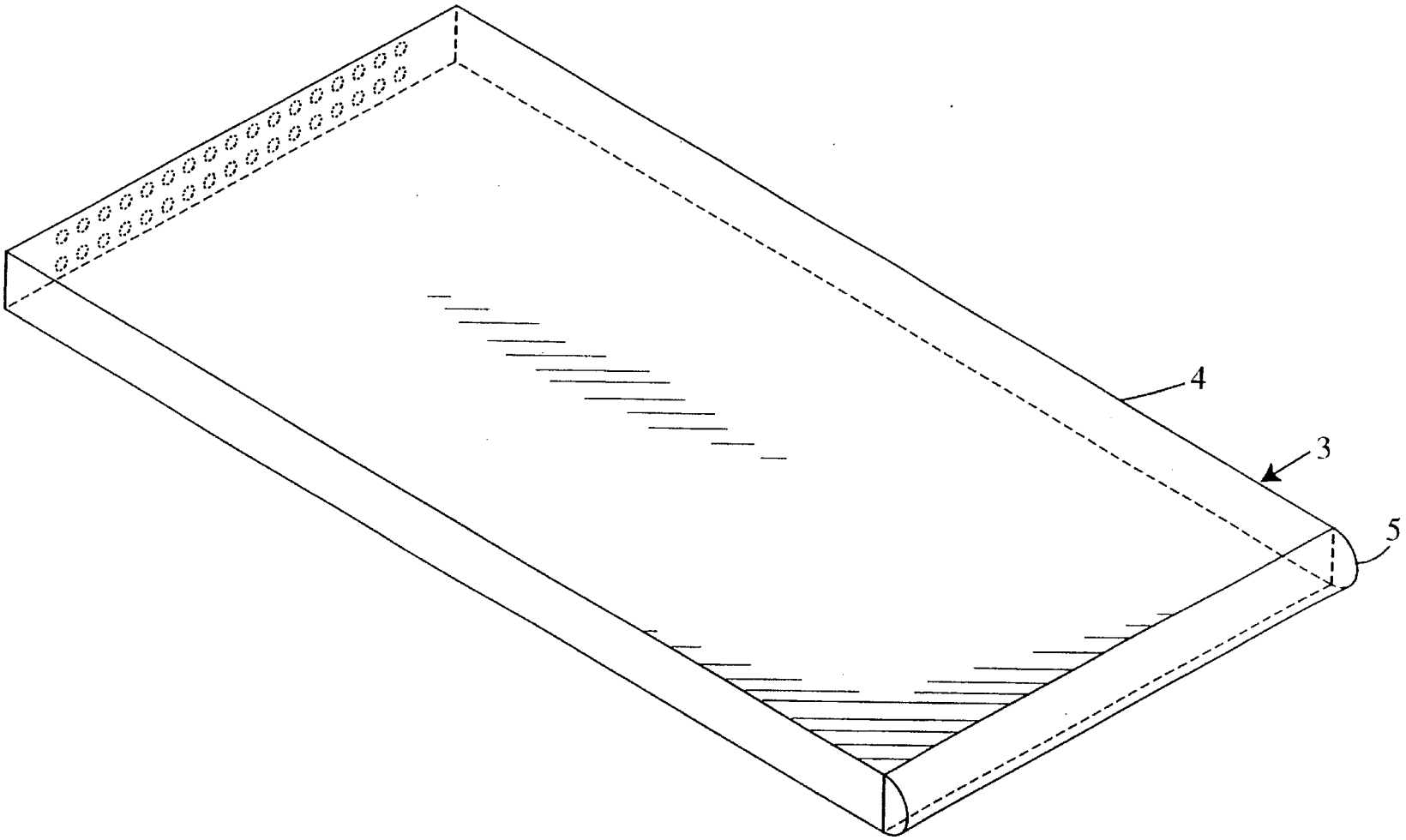
FIG. 3 is a diagram of a PCMCIA package including radio electronics, antenna, and containment, according to the present invention.

FIG. 3 is a substantially scale diagram of PCMCIA package 3 including shielded package 4 of radio electronics, antenna 6, and containment 5, according to the present invention. As is conventional, PCMCIA package 3 includes a connection edge 5' which electrically couples with a socket of electrical pins provided in a device or system with which PCMCIA package is 3 intended to operate. As the dimensions of PCMCIA package 3 are intended to be shown substantially in scale, the minimal impact of containment 5 upon the size and geometry of the overall PCMCIA package 3 is made evident. The low profile geometry of PCMCIA package 3 is a particular feature of the present invention.

Figure 4:
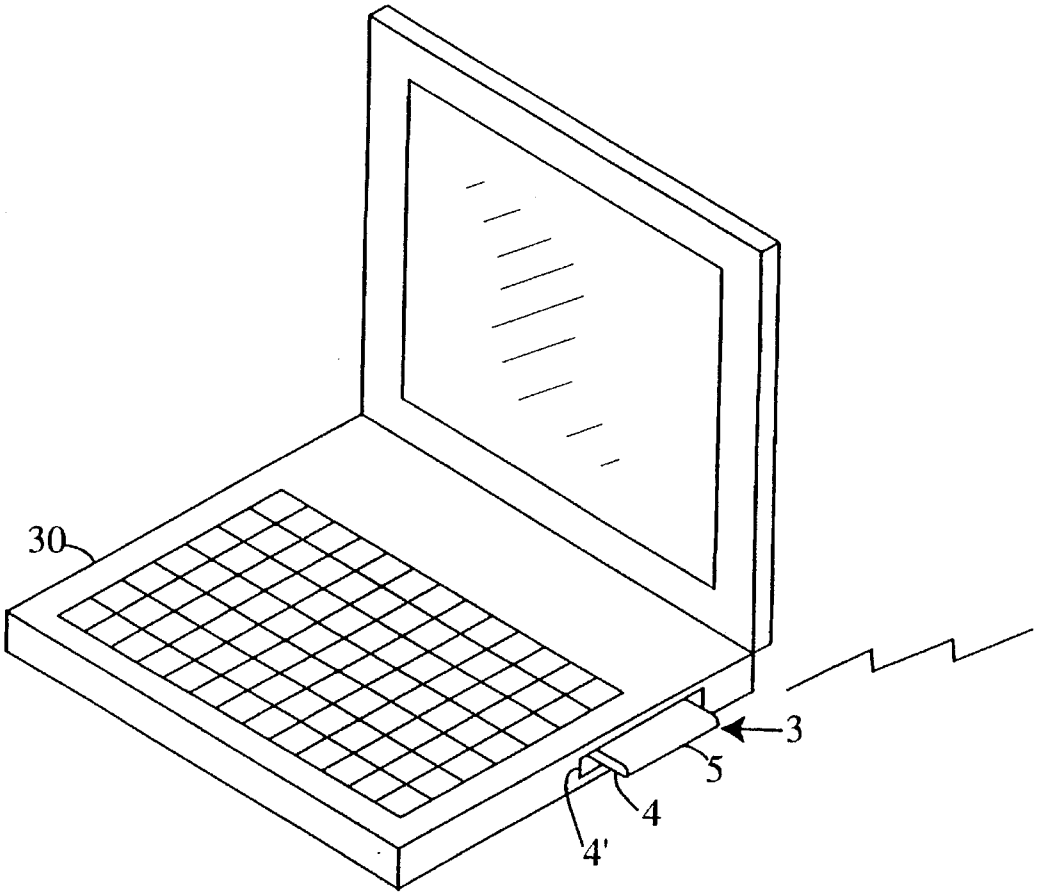
FIG. 4 is a diagram of a PCMCIA package according to the present invention, inserted into a receiving slot in a laptop computer for radio communication operation.

FIG. 4 is a diagram of a PCMCIA package 3 according to the present invention, inserted into a receiving slot in a laptop computer 30 for radio communication operation. As shown in FIG. 4, PCMCIA package 3 is inserted for operation into PCMCIA receiving slot 4'. Only a small portion of PCMCIA package 3 and shielded package 4, in particular, containment 5 extends significantly from the side of laptop computer 30. The particular level in which PCMCIA package 3 is set is indicative of the region in which PCMCIA radio communications can occur, in accordance with the present invention. By extending from the side of laptop computer 30 only minimally, considerable space savings are achieved. Further, the low profile of PCMCIA package 3, reduces the possibility of mechanical damage as a result of excessive extension out of PCMCIA slot 4'.

What is claimed is:

1. A PCMCIA package comprising:

a shielded package having a first and a second narrow edges and containing a communications system, said shielded package adapted for insertion at said first narrow edge into a selected PCMCIA slot of a PCMCIA host, said shielded package sized such that said second narrow edge is exposed and protruding slightly from the PCMCIA SlOt after insertion;

a containment, molded at said second narrow edge and defining a first chamber and a second chamber, the containment being transparent for allowing selected frequency ranges of electromagnetic energy to pass through: and a low-profile antenna, having a first leg, and a second leg, said first leg mounted within said first chamber of said containment and said second leg mounted within said second chamber of said containment for electromagnetic communication.

2. The PCMCIA package according to claim 1, wherein each of said first leg and said second leg are complementary L-shaped legs, each leg including a portion horizontal to said second narrow edge and a portion vertical to said second narrow edge, said horizontal portion meandering in a horizontal plane.

3. The PCMCIA package according to claim 2, wherein the respective horizontal portions of said first leg and said second leg are meandering along complementary zig-zag paths.

4. The PCMCIA package according to claim 1, wherein said low profile antenna is adapted to radiate electromagnetic energy within a plane of a computer having said PCMCIA slot for coupling said PCMCIA package.

5. The PCMCIA package according to claim 1, wherein said first and said second chambers are separated by a central ridge used to secure said containment to said second narrow edge of said shielded package.

6. The PCMCIA package according to claim 5 wherein said containment is attached with the second narrow edge of said shielded package with a single mechanical fastener.

7. The PCMCIA package according to claim 6 wherein said single mechanical fastener is connected with said central ridge.

8. The PCMCIA package according to claim I wherein said shielded package is a ground plane for said low-profile antenna.

9. The PCMCIA package according to claim 1, wherein the containment is a rounded semi-cylindrical shaped structure.

10. A compact, unitary PCMCIA radio antenna package comprising:

a shielded package for a communication system having a first and a second short edge and a first and a second long edge, said shielded package being insertable into a selected PCMCIA slot with a selected one of said short edges being at least partially exposed after insertion of said shielded package; and an antenna mounted on said selected one of said short edges for extension from said shielded package, wherein said antenna includes a first and a second L-shaped leg, each such leg including a portion horizontal to the short edge and a portion vertical to the short edge and said horizontal portions of said first and second L-shaped legs following predetermined complementary meandering paths.

11. A PCMCIA communication device comprising:

an electronics package having a first edge and a second edge and a first surface and a second surface, each edge and each surface shielded against electromagnetic energy transmission, the electronics package housing a communication system and the first edge having a PCMCIA interface connection for insertion into a PCMCIA slot and coupling a PCMCIA interface of a PCMCIA host and the shielded package sized such that the second edge is exposed and protruding slightly from the PCMCIA slot after coupling;

a low profile antenna having a first leg and a second leg, each leg coupled to the second edge of the electronics package, for at least one of transmission and reception of electromagnetic communication signals; and a containment having a first chamber and a second chamber, the containment mounted over the second edge and having the first chamber residing over the first leg and the second chamber residing over the second leg, the containment having a semicylindrical shape and being transparent to selected frequency ranges of electromagnetic energy for allowing at least one of a transmission or reception of an electromagnetic communication signal.

* * * * *

UNITED STATES PATENT AND TRADEMARK OFFICE

CERTIFICATE OF CORRECTION

PATENT NO. : 5,583,521

DATED : December 10, 1996

INVENTOR(S) : Anthony D. Williams

It is certified that error appears in the above-indentified patent and that said Letters Patent is hereby corrected as shown below:

In column 4, line 27, replace "SlOt" with --slot--.

In column 4, line 62, replace "claim I" with --claim 1--.

Signed and Sealed this

Eighteenth Day of March, 1997

*Attest:*

*Attesting Officer*

BRUCE LEHMAN

*Commissioner of Patents and Trademarks*